US005593198A

United States Patent [19]

Vogel, II

[11] Patent Number: 5,593,198

[45] Date of Patent: Jan. 14, 1997

[54] SNOW SCOOP APPARATUS

[76] Inventor: Frank D. Vogel, II, 1108 36th St., Parkersburg, W. Va. 26101

[21] Appl. No.: 541,517

[22] Filed: Oct. 10, 1995

[51] Int. Cl.[6] ..... E01H 5/02

[52] U.S. Cl. ..... 294/54.5; 294/53.5; 294/59

[58] Field of Search ..... 294/9, 51, 53.5, 294/54.5, 55, 57, 58, 59; 37/264–267, 285; 15/257.1, 257.4, 257.7

[56] References Cited

U.S. PATENT DOCUMENTS

| | | | |
|---|---|---|---|
| 2,666,662 | 1/1954 | McLeod | 294/55 |
| 2,728,598 | 12/1955 | Szillage | 294/54.5 |
| 3,659,888 | 5/1972 | Dreier | 294/55 |
| 3,802,729 | 4/1974 | Akre | 294/55 |
| 4,094,543 | 6/1978 | Fratini | 294/54.5 |
| 4,669,206 | 6/1987 | Yost | 294/54.5 |

*Primary Examiner*—Dean Kramer
*Attorney, Agent, or Firm*—George J. Neilan

[57] ABSTRACT

A snow scoop which is slid along the ground into the snow to be removed, a movable handle which may be rotated to positions to either push or pull the scoop into the snow, a hinged scraper at the entrance to the scoop, and the handle being pivotal to a generally upright position, close to a user's body in order to lift up the open end of the scoop and discharge snow rearwardly over the rear wall of the scoop.

6 Claims, 1 Drawing Sheet

SNOW SCOOP APPARATUS

BACKGROUND OF THE INVENTION

I. Field of the Invention

The present invention relates to apparatus for the removal of snow from side walks, driveways, and the like.

II. Prior Art

It is well known that convention snow shovels may cause serious health problems for users, such as back pain due to the repetitive lifting of the weight of the snow on the end of a conventional shovel. The unaccustomed activity in cold weather is also the cause of heart attacks and death.

As improvements over conventional snow shovels, various scoop devices typically mounted upon wheels near the rear of the scoop have been proposed in the prior art. In general, the front end of such scoops are dipped into the snow to pick up the snow. Thereafter, the scoops are pivoted on the wheels and transported to another location where the snow is dumped out the front of the scoop.

SUMMARY OF THE INVENTION

A primary object of the present invention is to provide a novel snow scoop apparatus which may remove, relocate, and dump snow with less effort than conventional snow shovels. Briefly, the novel apparatus of the present invention includes any elongated snow scoop that is open at one end, a bottom portion for sliding along the surface of the ground, and a pivotal handle located at its lower end adjacent the upper end of the scoop. The handle is inclined at an acute angle to the ground when the scoop is to be slid into the snow. When snow is to be discharged out the back of the scoop, the handle is pivoted to a vertical position about at right angles to the ground and the handle may be elevated to discharge snow over the back end of the scoop without the user bending over. The handle is preferably attached to a hinged scraper at the open end of the scoop. The hinged scraper may be pivoted upwardly to assist in keeping snow in the scoop during transport.

The scoop has a low profile and thus may be used to remove snow from under objects that have a low clearance to the ground, for example, from underneath an automobile.

DESCRIPTION OF THE PREFERRED EMBODIMENTS

Figure 1:
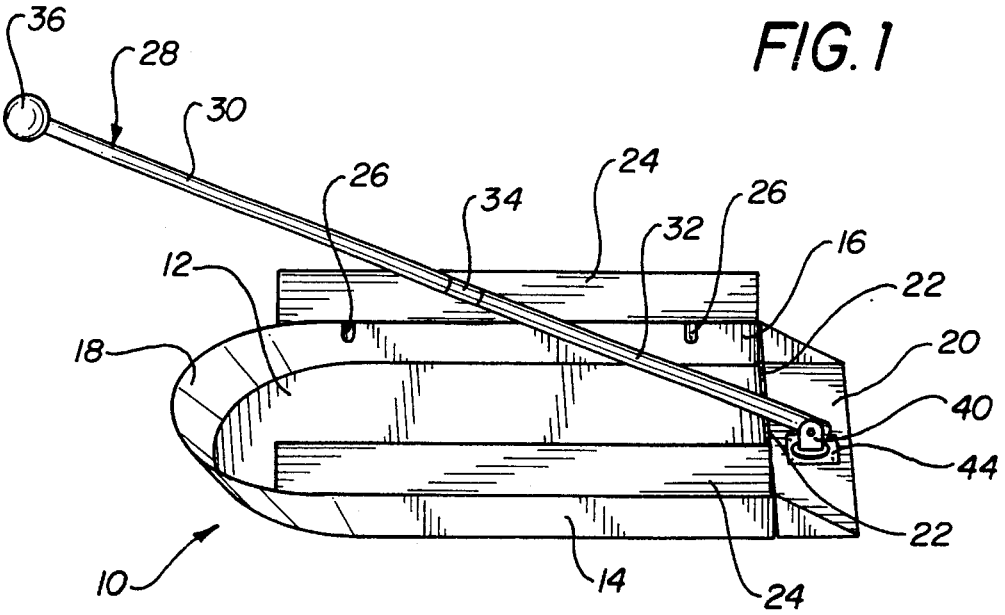
FIG. 1 is a perspective view of the snow scoop of the present invention.
Figure 2:
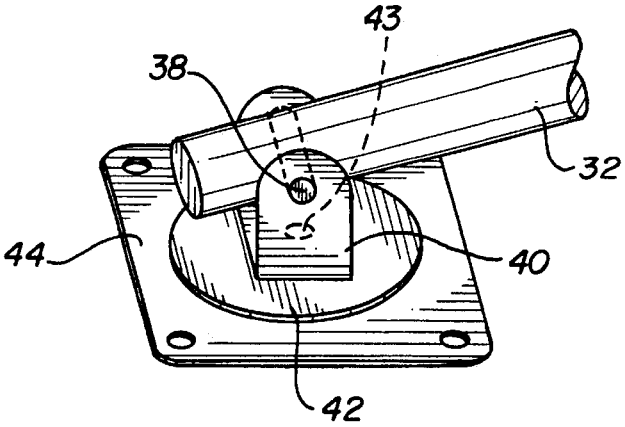
FIG. 2 is a detail view showing the dual pivot assembly for the handle.

Referring to the drawings and more particularly FIG. 1, reference numeral 10 designates an elongated scoop. The scoop has a ridged generally flat bottom 12 for sliding along the ground and is made of a durable material to withstand winter use and contact with hard ground, and ice and snow. The scoop also has side walls 14, 16, and an arcuate rear wall 18.

At the open end of the scoop body 10 there is a scraper 20 attached to the bottom 12 by a pair of hinges 22. The capacity of the scoop may be increased by adding removable side panels 24 that have tubular extensions received in complimentary recesses 26 in side walls 14 and 16.

A handle generally designated 28 is utilized to maneuver the scoop. The handle includes an upper tubular section 30 and a lower tubular section 32 connected to each other by a threaded coupling 34. A knob 36 at the upper free end of handle 28 is utilized to pull or push on the scoop, as will become more apparent hereinafter.

Figure 3:
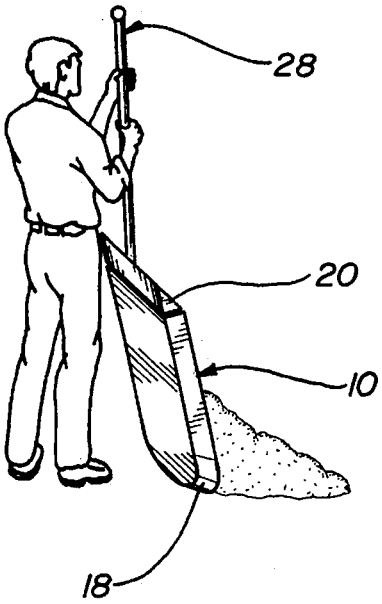
FIG. 3 is an elevational view showing the position of the scoop when the handle has been lifted up to dump snow from the scoop.

The lower end of the lower handle section 32 is mounted on a pivot pin 38 in pivot support 40 so that the handle may be pivoted in a vertical plane through approximately 180 degrees. The lower end 42 of support 40 is freely rotatable about a pivot 43 in a coupling 44 that is attached to the scraper 20. Rotation of the lower end 42 of support 40 enables the handle 28 to be rotated through 360 degrees about the axis of the pivot 43. To remove snow from side walks, driveways, and other areas, the user grasps the handle 28 and knob 36 with the handle in an inclined position such as shown in FIG. 1; and pushes the scoop 10 into the snow to be removed. Scraper 20 is now in the down position shown in FIG. 1 in alignment with the scoop bottom 12. After the scoop is filled with snow to the extent desired; the user pulls back on handle 28 initially causing scraper 20 to swing upwardly about hinges 22 and retain the collected snow in the scoop. Further pulling on handle 28 pulls the scoop and the collected snow away from the snow bank. The scoop is then moved to the area where it is to be dumped. Handle 28 is then swung around pivot pin 38 to an approximately vertical position. As seen in FIG. 3, the user may progressively raise the handle 28 hand over hand, causing snow to be dumped out over the rear wall 18 of the scoop 12.

As an alternative, in some instances, it is possible to discharge snow from the scoop by pushing the scoop towards the region where the snow will be stored with an abrupt motion with scraper 20 in the down position, so that momentum causes the snow to slide out of the scoop over scraper 20.

The movable handle 28 has various advantages including that the handle may be pushed downwardly from the FIG. 1 position in the event that snow is to be gathered under low objects such as under an automobile. The handle 20 may be rotated about a horizontal axis to either push the scoop as in the FIG. 1 position into the snow, or if the handle is swung far to the right in FIG. 1; the scoop 10 may be pulled into the snow by the handle. Because the handle may be adjusted automatically to the height of the user, less pressure is placed on the user's back when collecting snow. When dumping collected snow, with the handle 28 and the load being close to the user's body, there is less strain on the user's back. The apparatus may also be used to remove snow from sloped roofs. The hinged scraper 20 allows closer gathering of snow on slopes and inclines due to the flexibility of the hinged scraper as compared to a fixed edge.

I claim:

1. Apparatus for snow removal comprising a scoop having a bottom wall for sliding along the ground, said scoop including a pair of side walls and a rear wall, an open end of said scoop being provided at one end of said side walls, a movable handle connected adjacent said open end of said scoop, a scraper, hinge means to connect said scraper to said bottom wall at said open end of said scoop, and pivot means mounted on said scraper to enable said handle to move from an acute angle suitable for pushing said open end of said scoop into snow to a generally vertical alignment to enable elevation of said open end of said scoop to discharge snow over said rear wall of said scoop.

2. Apparatus according to claim 1, further comprising a knob at the upper end of said handle.

3. Apparatus according to claim 1, wherein said pivot means enable said handle to rotate about both a horizontal axis and a vertical axis.

4. A method for snow removal employing a scoop having a bottom wall, a pair of side walls, and a rear wall, with an open end provided at one end of said side walls, and a movable handle connected adjacent said open end, comprising pivoting the handle to an acute angle, pushing said open end into snow to be removed, moving said scoop to a snow discharge area, pivoting said handle to a generally vertical alignment close to a user's body, and lifting said handle to elevate said open end and to discharge snow rearwardly over said rear wall of said scoop.

5. Apparatus for snow removal comprising a scoop having a bottom wall for sliding along the ground, said scoop including a pair of side walls and a rear wall, an open end of said scoop being provided at one end of said side walls for receiving snow to be removed, a movable handle connected adjacent said open end of said scoop, pivot means to enable said handle to move from an acute angle suitable for pushing said open end of said scoop into snow to a generally vertical alignment close to a user's body to enable elevation of said open end of said scoop to discharge snow rewardly over said rear wall of said scoop, a scraper, and hinge means to connect said scraper to said bottom wall at said open end of said scoop.

6. Apparatus for snow removal comprising a scoop having a bottom wall for sliding along the ground, said scoop including a pair of side walls and a rear wall, an open end of said scoop being provided at one end of said side walls for receiving snow to be removed, a movable handle connected adjacent said open end of said scoop, and pivot means to enable said handle to rotate about both a horizontal axis and a vertical axis and to enable said handle to move from an acute angle suitable for pushing said open end of said scoop into snow to a generally vertical alignment close to a user's body to enable elevation of said open end of said scoop to discharge snow rearwardly over said rear wall of said scoop.

* * * * *